US006267632B1

(12) United States Patent
Blanchard

(10) Patent No.: US 6,267,632 B1
(45) Date of Patent: Jul. 31, 2001

(54) WATER JET PROPULSION APPARATUS WITH INBOARD MOUNTED POWER SOURCE

(75) Inventor: Clarence E. Blanchard, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/456,161

(22) Filed: Dec. 7, 1999

(51) Int. Cl.[7] ..... B63H 11/00

(52) U.S. Cl. ..... 440/38; 440/41; 440/42; 440/47

(58) Field of Search ..... 440/38, 40, 41, 440/42, 43, 46, 47, 75

(56) References Cited

U.S. PATENT DOCUMENTS

| | | | | |
|---|---|---|---|---|
| 2,975,750 | | 3/1961 | Smith | 115/41 |
| 3,073,277 | * | 1/1963 | Lee | 440/43 |
| 3,343,368 | * | 9/1967 | Castoldi | 440/46 |
| 3,476,070 | | 11/1969 | Austen | 115/5 |
| 3,572,281 | | 3/1971 | Becker | 115/37 |
| 3,603,278 | | 9/1971 | Gehlen | 115/35 |
| 3,847,108 | * | 11/1974 | Shimanckas | 440/75 |
| 4,010,707 | * | 3/1977 | Bendall | 440/42 |
| 5,181,868 | | 1/1993 | Gabriel | 440/38 |

FOREIGN PATENT DOCUMENTS

| | | |
|---|---|---|
| 262306 | 5/1963 | (AU) . |
| 481788 | 1/1970 | (CH) . |
| 560126 | 3/1975 | (CH) . |
| 1321564 | 2/1963 | (FR) . |
| 724662 | 11/1966 | (IT) . |
| 49-73196 | 7/1974 | (JP) . |
| 50-12672 | 2/1975 | (JP) . |
| 83/00125 | 1/1983 | (WO) . |

* cited by examiner

*Primary Examiner*—Sherman Basinger
(74) *Attorney, Agent, or Firm*—Dennis M. Flaherty

(57) ABSTRACT

A boat or other water craft having an inboard engine, an outboard pump jet apparatus and a transom plate on which the pump jet apparatus is pivotably mounted. The boat hull bottom has a water tunnel formed therein, the transom plate has a tube portion in flow communication with the water tunnel, and the pump jet apparatus has an inlet which, in the operating position of the pump jet, is in flow communication with the tube portion of the transom plate. The pump jet apparatus is selectively pivotable between an operating position and a service position. In the service position the pump jet inlet is accessible to a boat occupant to clear debris from the pump jet inlet.

19 Claims, 6 Drawing Sheets

WATER JET PROPULSION APPARATUS WITH INBOARD MOUNTED POWER SOURCE

FIELD OF THE INVENTION

This invention generally relates to pump jet apparatus which are mounted to the hull of a boat or other water craft. In addition, the invention relates to mechanisms for transmitting motive power from an inboard marine engine to an outboard pump jet.

BACKGROUND OF THE INVENTION

It is known to propel a boat or other water craft using a pump jet apparatus mounted to the hull, with the powerhead being placed inside (inboard) the hull. The drive shaft of the pump jet apparatus is coupled to the output shaft of the inboard motor. The impeller is mounted on the drive shaft and housed in a jet propulsion pipe or water tunnel.

To facilitate use of pump jet-propelled boats in shallow water, it is known to mount the pump jet at an elevation such that the pump jet does not project below the bottom of the boat hull. This can be accomplished, for example, by installing a duct in the stern of the boat, the duct being arranged to connect one or more inlet holes formed in the bottom of the hull with an outlet hole formed in the transom. The pump jet is then installed outside the hull in a position such that the pump jet inlet is in flow communication with the duct outlet at the transom. Such a system is shown in Australian Patent Specification No. 262306, published in 1963. Alternatively, the pump jet can be installed inside the duct built into the hull, as shown in U.S. Pat. No. 5,181,868.

Alternatively, a water tunnel can be formed in the stern of the boat hull, the water tunnel having a height which gradually increases from the hull bottom at a point in front of the transom to a maximum height at the transom. In one type of design, the pump jet is placed so that its inlet is in flow communication with the outlet of the water tunnel. One example of this type of system is shown in Italian Publication No. 724662.

In another type of design, part of the pump jet apparatus is installed inside the hull while the remaining part penetrates the transom and extends to the rear of the hull. An inlet housing of the pump jet has a horizontal opening and an inclined water tunnel for guiding water to the impeller. The horizontal opening of the inlet housing is mounted in a hole in the bottom or near the bottom of the hull. A similar design is disclosed in Swiss Patent No. 481788.

In many pump jet units powered by inboard engines, the drive shafts and pump mountings (which must penetrate the hull) are placed below the waterline. Such a mounting system has the disadvantage that various gaskets and seals are required to ensure the integrity of the installation. Leakage at any of the mounting and shafting locations can be disastrous.

In addition, in the event that the inlet to the pump jet becomes clogged with debris, permanent mounting of the pump jet makes it difficult to clean out the debris from the inlet. In some instances, removal of the ingested or entangled debris requires that the boat user enter the water or even that the boat be lifted out of the water.

Thus, an arrangement for mounting a pump jet in flow communication with a water tunnel wherein the hull penetrations are located above the waterline provides an advantage. Further, it would be advantageous to mount the pump jet in such a way that it can be removed from its position in flow communication with the water tunnel and into a position which allows easy access to any debris clogging the pump jet inlet.

SUMMARY OF THE INVENTION

One aspect of the present invention encompasses a boat or other water craft having a marine propulsion system comprising an inboard engine, an outboard pump jet apparatus and a transom plate on which the pump jet apparatus is pivotably mounted. In accordance with one preferred embodiment of the invention, the boat hull bottom has a water tunnel formed therein, the transom plate has a tube portion in flow communication with the water tunnel, and the pump jet apparatus has an inlet which, in the operating position of the pump jet, is in flow communication with the tube portion of the transom plate.

The present invention is also directed to an arrangement for providing a boat or other water craft with a pump jet apparatus which is selectively movable from an operating position to a service position and vice versa. In the operating position the pump jet inlet is inaccessible to an occupant of the boat, whereas in the service position the pump jet inlet is accessible, enabling a boat occupant to clear debris from the pump jet inlet. In accordance with a preferred embodiment, the pump jet apparatus is pivotably mounted on the transom plate. When the pump jet is pivoted away from the operating position, the pump jet inlet is disengaged from the tube portion of the transom plate, into a position which allows easy access to remove the debris clogging the pump jet inlet.

In accordance with a further preferred embodiment, the drive shaft connecting the inboard engine to the outboard upper gear assembly and the bolts used to mount the transom plate each penetrate the transom at an elevation above the waterline. This has the benefit that failure of any gasket or seal will not cause disastrous leakage so long as the penetrations remain above the waterline.

Another aspect of the invention encompasses a transom plate for mounting on a boat transom. In accordance with a preferred embodiment, the transom plate comprises a plate having upper and lower portions, and a tube portion connected to the lower portion of the plate. The transom plate further comprises first and second journal boxes connected to the upper portion of the plate for housing a compound gear and various bearings which allow the pump jet apparatus to pivot relative to the transom plate.

The invention is further directed to a pump jet arrangement for mounting on a transom of a boat hull, comprising: a rotor shaft; a rotor (impeller) mounted on the shaft; a drive train coupled to the rotor shaft; a mounting plate having holes for mounting on a transom of a boat hull; a first water tunnel portion connected to the mounting plate and having an inlet and an outlet; a drive train casing pivotably coupled to the mounting plate and encasing a vertical portion of the drive train, the drive train casing being pivotable relative to the mounting plate between first and second positions; and a second water tunnel portion connected to the drive train casing and having an inlet and an outlet, the rotor being housed inside this second water tunnel portion. The inlet of the second water tunnel portion and the outlet of the first water tunnel portion are in abutment when the drive train casing is in the first position and are not in abutment when the drive train casing is in the second position. The inlet of the second water tunnel portion and the outlet of the first water tunnel portion present substantially the same cross-sectional shape to water flowing therethrough.

Another aspect of the invention is the provision of a sealed pivot arrangement which allows the drive train casing of the pump jet apparatus to pivot relative to the mounting plate. The horizontal portion of the drive train penetrates the drive train casing from the side, along the axis of pivoting. Thus the drive train casing and the horizontal portion of the drive train will have relative rotation but no relative displacement during pivoting of the drive train casing.

DETAILED DESCRIPTION OF THE PREFERRED EMBODIMENTS

Figure 1:
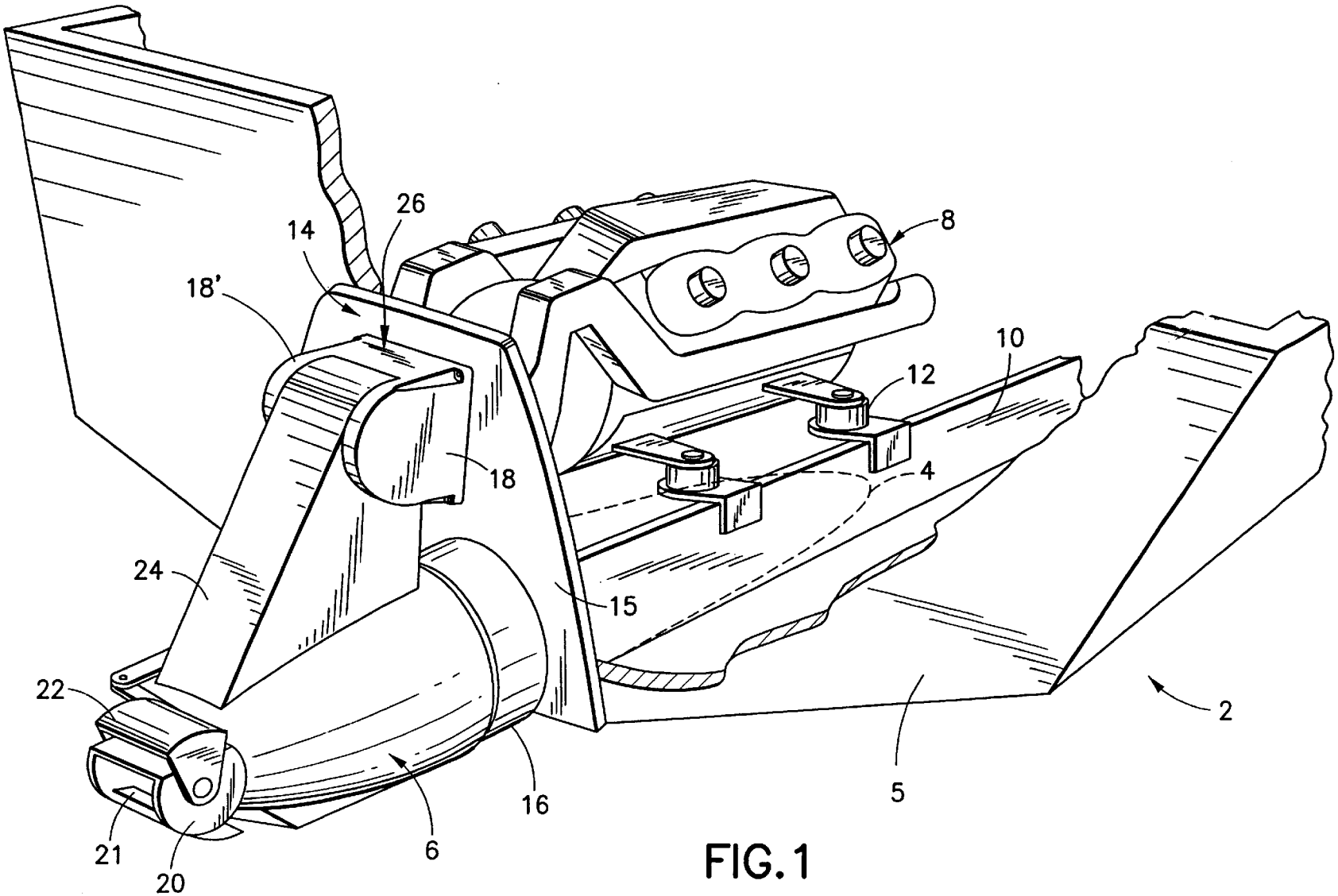
FIG. 1 is a schematic showing an isometric view of the stern a boat with an inboard engine and an outboard pump jet pivotably mounted on a transom plate in accordance with one preferred embodiment of the invention. Part of the transom is cut away to reveal the inboard engine, while the outline of the water tunnel is partly indicated by the dashed curved line.
Figure 2:
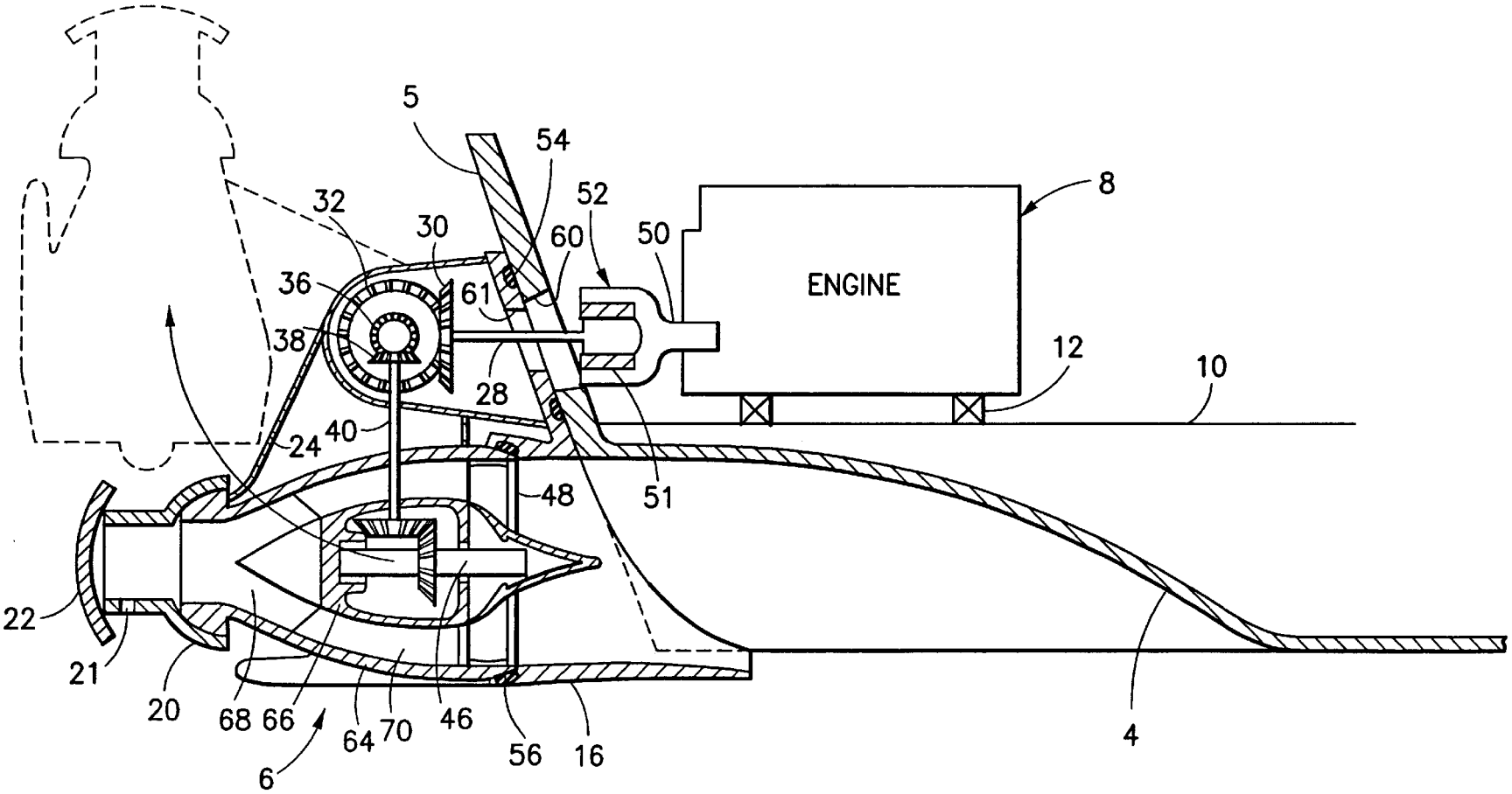
FIG. 2 is a schematic showing a sectional elevational view of the preferred embodiment depicted in FIG. 1. The service position of the pump jet apparatus is indicated by dashed lines.
Figure 7:
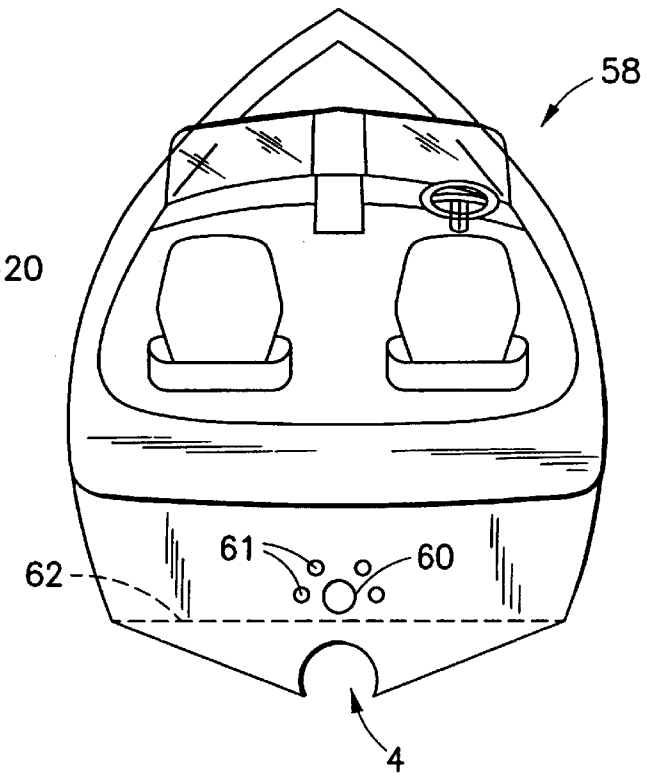
FIG. 7 is a schematic showing an isometric view of a boat in accordance with the preferred embodiment, wherein the transom plate mounting holes and the drive shaft penetration are located above the waterline.

In accordance with the preferred embodiment shown in FIGS. 1 and 2, a boat has a hull 2 with a water tunnel 4 formed in its stern. The water tunnel 4 has a height which gradually increases from its starting point to a maximum height located at the transom 5. It should be understood that the water tunnel 4 forms a recess in the transom 5, as best seen in FIG. 7. Preferably, the water tunnel 4 is located along the centerline or keel of the hull 2. However, it will be readily appreciated that more than one water tunnel can be formed in the hull if multiple stern drive units are installed, one water tunnel for each pump jet.

In addition, the preferred embodiment comprises an outboard pump jet 6 powered by an inboard engine 8. Preferably the engine 8 is mounted on a pair of hull stringers 10 by means of a plurality of motor mounts 12. Also shown in FIGS. 1 and 2 is a transom plate 14, comprising a plate 15 having a lower portion connected to a tube portion 16 and an upper portion connected to an upper gear housing 26. The tube portion 16 effectively becomes an extension of the water tunnel 4, i.e., is in flow communication with the water tunnel 4. Preferably the shape of the tube portion 16, at the inlet where it meets the water tunnel 4, should conform to the shape of the latter, thereby allowing water to flow along a smooth transition from the water tunnel 4 into the tube portion 16. Similarly, the inlet to the pump jet 6 is in flow communication with the outlet of tube portion 16. Thus tube portion 16 of the transom plate 14 guides flowing water from the water tunnel 4 into the pump jet 6. The water exits the pump jet 6 via a conventional steering nozzle 20. The water flow exiting the steering nozzle 20 can be reversed by activation of a conventional reverse gate 22, which causes exiting water to flow through a slot 21 formed in the steering nozzle and in a reverse direction. The steering and shifting controls for controlling the positions of the steering nozzle and the reverse gate comprise well-known structures such as cables, links and levers, the bulk of which are not shown in the drawings to avoid unnecessary complication in the depiction of the preferred embodiment.

The pump jet 6 is preferably pivotably coupled to the upper gear housing 26 of the transom plate 14 via a drive train casing 24 (see FIG. 1). Casing 24 houses the upper portion of the vertical gear drive train; the upper gear housing 26 houses the aft portion of the horizontal drive train which couples the pump jet to the inboard motor 8. The upper gear housing 26 rotatably supports the drive train casing 24 to allow tilt pivoting of the jet pump 6 and drive train casing 24, hereinafter collectively referred to as the "pump jet apparatus".

Figure 3:
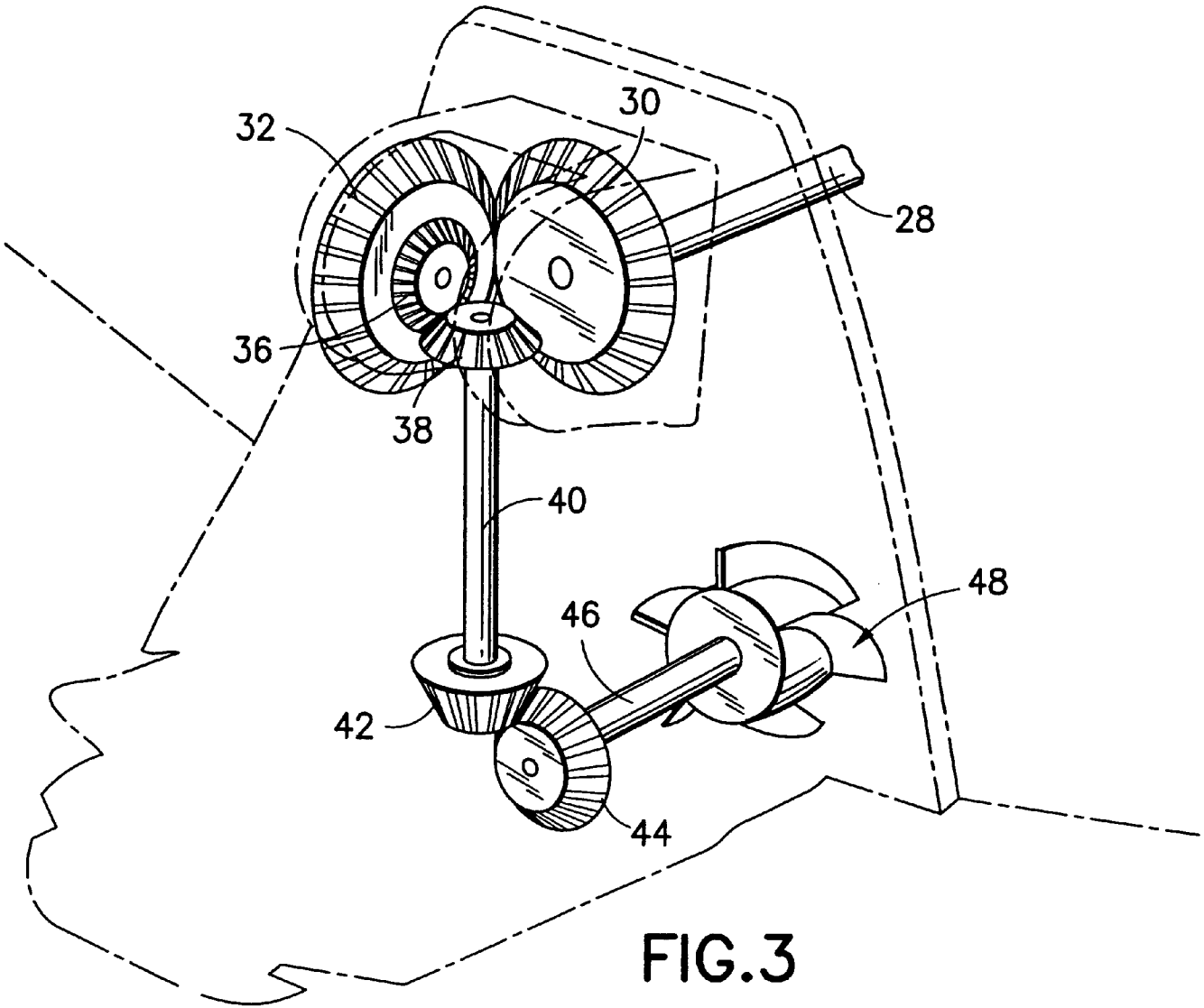
FIG. 3 is a schematic showing an isometric view of the gear drive train in accordance with the preferred embodiment shown in FIGS. 1 and 2. The outlines of the transom plate and the pump jet are shown in dashed lines.

Referring to FIGS. 2 and 3, a preferred embodiment of the drive train from the engine 8 to the pump jet 6 will now be described. This drive train powers the pump jet in the operating position, but allows the pump jet to be tilted from the operating position to the service position, the latter being indicated by dashed lines in FIG. 2. Referring to FIG. 2, the drive train comprises an engine output shaft 50 coupled to a horizontal drive shaft 28 by means of a coupling 52. A vibration damper 51 made of rubber is installed inside the coupling, i.e., surrounding a splined end of drive shaft 28. The drive shaft 28 penetrates the transom 5 via a hole 60, penetrates the plate 15 via a hole 61 and extends into the upper gear housing 26. The interface between the transom plate and the transom and surrounding the hole 60 is sealed by a seal 54.

A bevel drive gear 30 is mounted to the end of drive shaft 28. The teeth of bevel drive gear 30 engage a large-diameter bevel gear 32 of a compound gear, which also has a small-diameter bevel gear 36 which is coupled to bevel gear 32 (best seen in FIG. 5). Thus rotation of drive gear 30 causes bevel pinion 36 to rotate. The teeth of bevel gear 36 mesh with a bevel gear 38 mounted to the end of a vertical drive shaft 40, which penetrates the pump jet housing. The opposite end of the vertical drive shaft 40 has a bevel gear 42 mounted thereto. The bevel gear 42 in turn meshes with a bevel gear 44 mounted on a rotor shaft 46 which has a portion extending forward of the vertical shaft 40. The rotor (i.e., impeller) 48 is mounted on the forward end of the rotor shaft 40 and may have a conventional structure. The rotor shaft 40 is supported by bearings (not shown) arranged inside a hollow hub 66 having a streamlined exterior surface. The hub 66 is surrounded by a housing 64 having an inlet which is in flow communication with the outlet of tube portion 16 of the transom plate. The interface between the housing 64 and the tube portion 16 is sealed by a seal 56. The interior surface of a housing 64 is streamlined, so that the opposing surfaces of the housing 64 and hub 66 define a circumferential passageway 68 through which the impelled water flows. The housing 64 and 66 are preferably connected by a plurality of stator vanes 70.

In accordance with the foregoing drive train, the engine 8 drives the rotor shaft 46 to rotate via drive shafts 28 and 40, and gears 30, 32, 36, 38, 42 and 44. Rotation of the rotor shaft 46 in turn causes the rotor 48 to rotate. During rotation, the angled blades of the rotor 48 impel water in the aft direction through the circumferential passageway between housing 64 and hub 66. The stator vanes 70 function to redirect the swirling flow out of the rotor and eliminate swirl. Provided that the reverse gate 22 is in the raised position, the water exits the steering nozzle 21 as a downstream jet. FIG. 2 shows the reverse gate 22 in the lowered position, which would cause the flow to reverse, as previously described.

Figure 6:
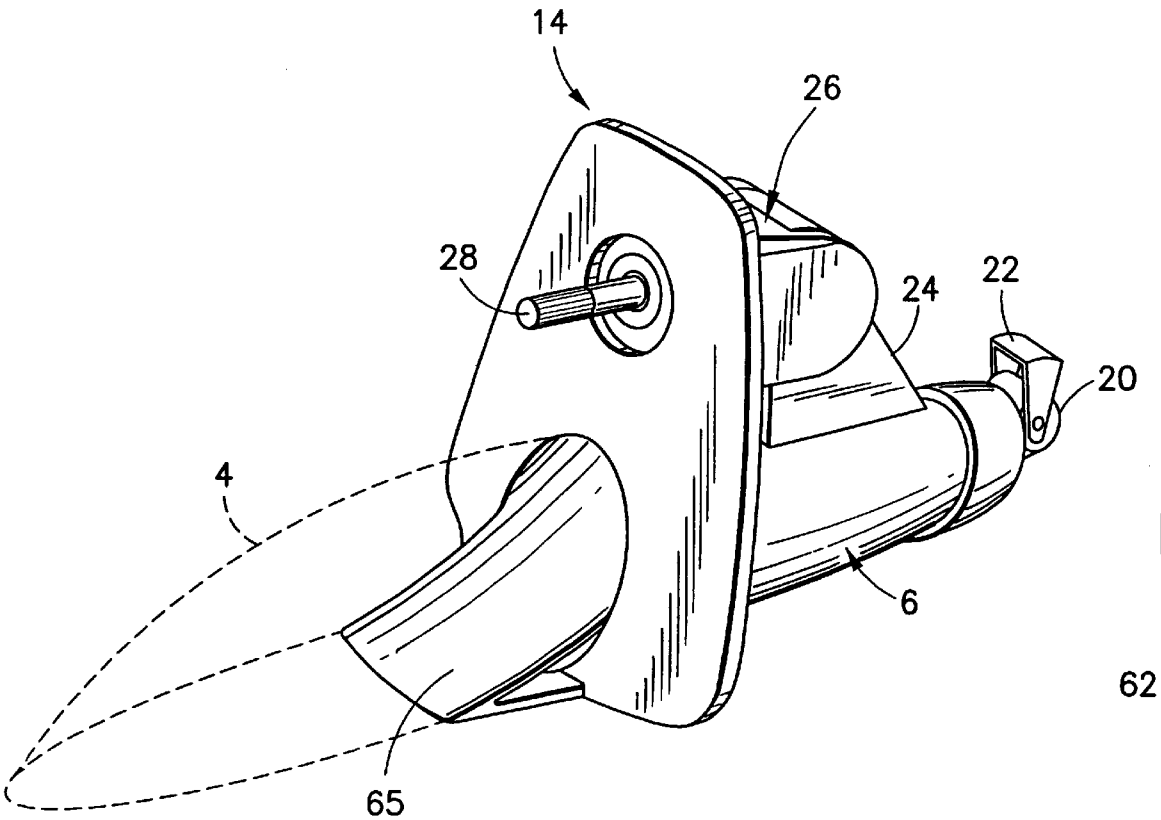
FIG. 6 is a schematic showing an isometric view of the transom plate and attached pump jet apparatus according to the preferred embodiment. The outline of the water tunnel formed in the boat hull is shown in dashed lines.

As best seen in FIGS. 2 and 6, the preferred embodiment of the transom plate further comprises a shovel-shaped scoop 65 which projects into and under the water tunnel 4 in the hull 2. Scoop 65 serves to guide water into the tube portion 16 of the transom plate.

In accordance with the preferred embodiment, the pump jet apparatus can be pivoted between an operating position (shown by solid lines in FIG. 2) and a service position (shown by dashed lines in FIG. 2). When the pump jet apparatus is pivoted from the operating position to the service position, the bevel gear 38 will travel freely along the periphery of gear 36, which is stationary. Thus the gear train poses no impediment (other than frictional forces) to tilt pivoting of the pump jet apparatus about a horizontal pivot axis. Conventional latching mechanisms may be used to latch the pump jet in its operating or service positions. Optionally, a handle or eyehook may be attached to the drive train casing 24 or to the pump jet housing for facilitating tilt pivoting of the pump jet by a person standing in the boat stern.

Figure 4:
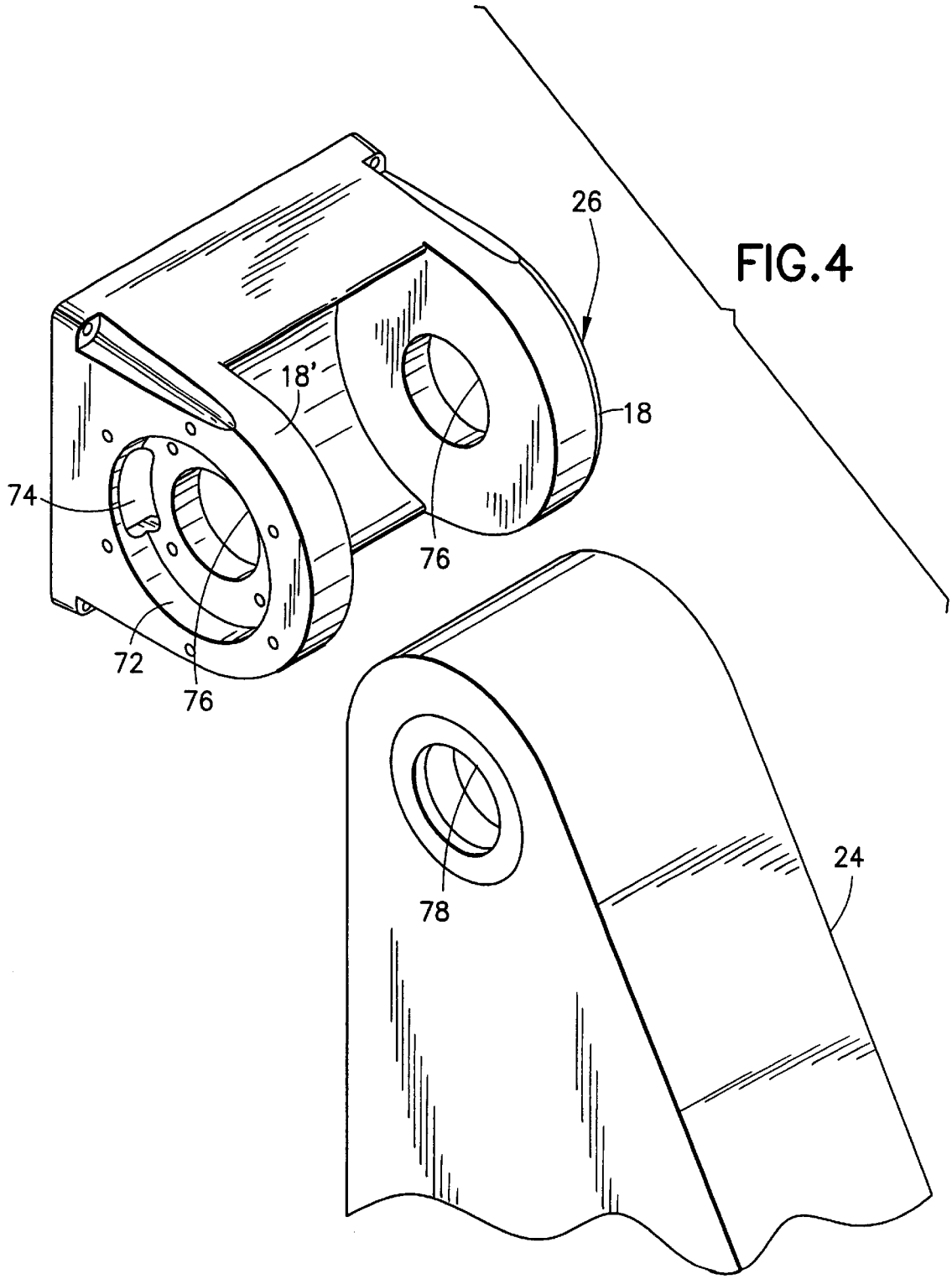
FIG. 4 is a schematic showing a sectional elevational view of pat of an exemplary pump jet apparatus which can be pivotably mounted on the transom plate disclosed herein.

The respective geometries and the positional relationship of the drive train casing 24 and the upper gear housing 26 can be seen in FIG. 4. The upper gear housing 26 comprises a pair of pivot supports 18 and 18'. The drive train casing 24 is received between the pivot supports. Each pivot support has a respective opening 76, while the opposing walls of casing 24 have respective openings 78, only one of which is visible in FIG. 4. The openings 76 have the same diameter and are coaxial. Similarly, the openings 78 have the same diameter as that of openings 76 and are coaxial. The bevel gear 32 of the compound gear is rotatably housed in the recess 72 of pivot support 18'. An opening 74, which communicates with recess 72, is provided in the wall of pivot support 18' to allow the outer perimeter of the drive gear 30 to penetrate into the recess 72 and mesh with the outer perimeter of the bevel gear 32.

Figure 5:
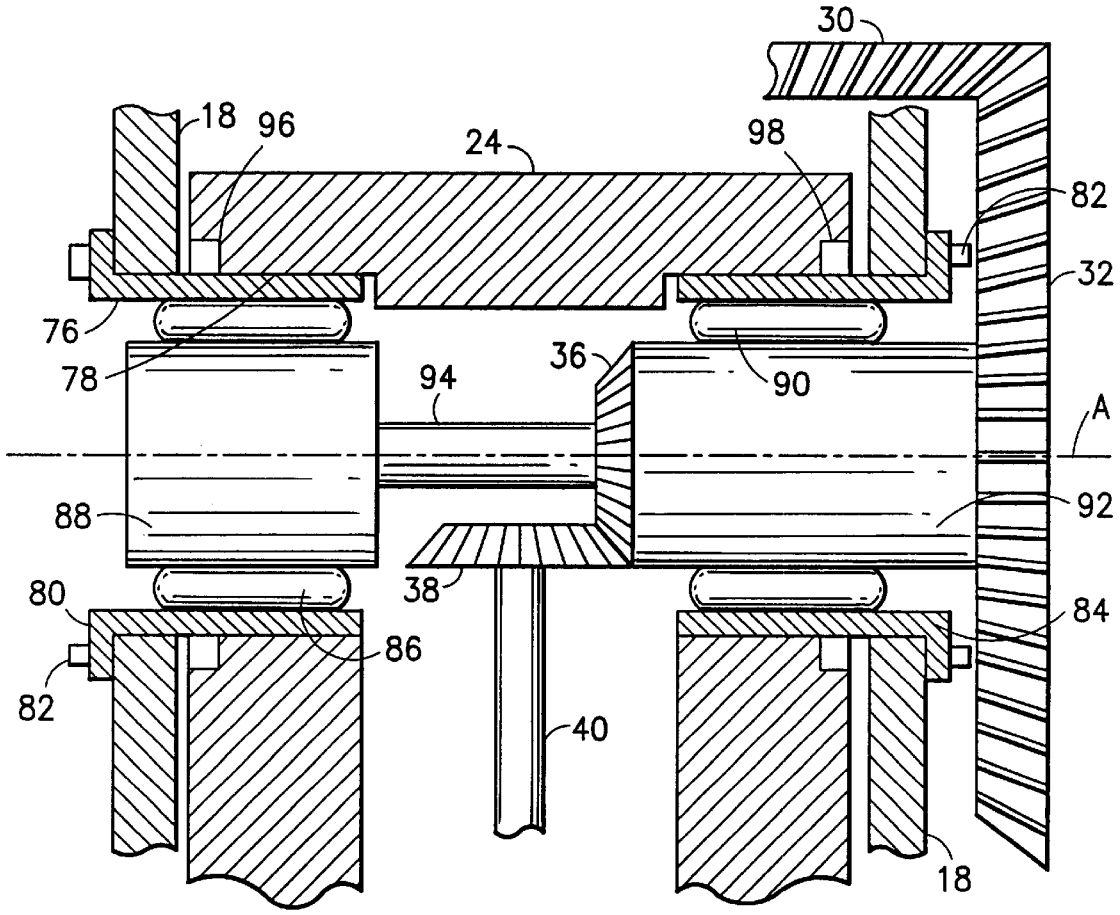
FIG. 5 is a schematic showing a sectional elevational view of the pivoting arrangement by which the drive train casing pivots relative to the mounting plate in accordance with the preferred embodiment.

The arrangement for pivotably coupling the drive train casing 24 to the upper gear housing 26 is generally shown in FIG. 5. In the assembled condition, the openings 76 of the upper gear housing 26 and the openings 78 of the drive train casing 24 are mutually coaxial. One bearing retainer 80 in the shape of a bushing is fastened by fasteners 82 to the pivot support 18, while another bearing retainer 84 in the shape of a bushing is fastened by fasteners 82 to the pivot support 18'. The bearing retainer 78 retains a bearing assembly 86 which supports a journal 88 of a compound shaft. The bearing retainer 82 retains a bearing assembly 90 which supports a journal 92 of the compound gear. The compound shaft also includes a small-diameter shaft 94. Both ends of shaft 94 (not visible in FIG. 5) are splined. One splined end fits inside a splined bore in the journal 88; the other splined end fits inside a splined bore in the compound gear.

In response to rotation of the drive gear 30, the compound gear and compound shaft assembly rotates about axis A. The meshing of bevel gear 36 with bevel gear 38 causes the vertical drive shaft 40 to be driven. During this rotation (and at all times), the fastened bearing retainers 80 and 84 are stationary. In accordance with the preferred embodiment of the invention, the drive train casing 24 is rotatable on the bearing retainers, thus enabling the casing 24 to pivot relative to the transom plate in the manner depicted in FIG. 2. The pivot axis is axis A in FIG. 5. Seals 96 and 98 serve to seal the interfaces between the drive train casing and the bearing retainers, thereby sealing against water leakage into the drive train casing. Because the pivot axis and the axis of the compound shaft/compound gear assembly are coaxial, the beveled teeth of the bevel gear 38 will intermesh with and travel along the beveled perimeter of bevel gear 36 when the drive train casing 24 is pivoted.

In accordance with the preferred embodiment, the transom plate of boat 58 is mounted to the transom so that the mounting holes 61 (see FIG. 7) are located above the waterline 62 in the hull. The circle designated by numeral 60 in FIG. 7 represents the shafting hole in the hull, which is penetrated by the drive shaft. However, if additional securement at lower positions on the transom is required, it is within the scope of the invention to mount the transom plate using extra mounting holes located below the waterline and therefore suitably sealed against leakage of water into the hull.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. For example, the tube portion of the transom plate may have a cross section which is not circular. Therefore, it is intended that the invention not be limited to the particular embodiment disclosed as the best mode contemplated for carrying out this invention, but that the invention will include all embodiments falling within the scope of the appended claims.

What is claimed is:

1. A boat comprising a hull with a transom and a transom plate mounted on the outboard side of said transom, said transom plate comprising a plate having upper and lower portions, and a tube portion connected to said lower portion of said plate, and said hull comprising a water tunnel in flow communication with said tube portion, further comprising an inboard engine, a water jet propulsion unit which is pivotable relative to said transom plate about a transverse pivot axis and a drive train for coupling said water jet propulsion unit to said engine, said drive train comprising a gear which rotates about an axis which is coaxial with said transverse pivot axis.

2. The boat as recited in claim 1, wherein said plate has a plurality of mounting holes formed in said upper portion, and said boat has a plurality of mounting holes formed in said transom above a waterline of said boat in respective alignment with said plurality of mounting holes formed in said upper portion of said plate.

3. The boat as recited in claim 1, further comprising a pump jet apparatus mounted outside said hull, wherein said transom plate further comprises means for pivotably supporting said pump jet apparatus.

4. The boat as recited in claim 3, wherein said pump jet apparatus comprises a drive train casing and a pump jet connected to said drive train casing, and said means for pivotably supporting said pump jet apparatus comprise an upper gear housing connected to said upper portion of said plate and a pivot assembly for pivotably coupling said drive train casing to said upper gear housing.

5. The boat as recited in claim 4, further comprising an engine mounted inside said hull, and a drive train penetrating said transom, said upper gear housing and said drive train casing, said drive train coupling said pump jet to said engine.

6. The boat as recited in claim 5 wherein a portion of said drive train is coaxial with a pivot axis of said drive train casing.

7. The boat as recited in claim 3, wherein said pump jet apparatus further comprises a housing having an inlet in flow communication with said tube portion of said transom plate.

8. The boat as recited in claim 3, wherein said pump jet apparatus comprises a drive train casing and a pump jet connected to said drive train casing, said drive train casing being pivotably mounted to said transom plate for pivoting about a pivot axis.

9. A boat comprising:

a hull comprising a bottom and a transom, said hull bottom having a water tunnel formed therein;

a transom plate mounted on the outboard side of said transom, said transom plate comprising a plate having upper and lower portions, and a tube portion connected to said lower portion of said plate, and said tube portion forming a water passage in flow communication with said water tunnel;

a pump jet apparatus mounted outside said hull and comprising a drive train casing and a pump jet connected to said drive train casing;

means for pivotably supporting said pump jet apparatus relative to said transom plate, said means comprising an upper gear housing connected to said upper portion of said plate and a pivot assembly for pivotably coupling said drive train casing to said upper gear housing, said drive train casing having a pivot axis;

an engine mounted inside said hull; and a drive train penetrating said transom, said upper gear housing and said drive train casing, said drive train coupling said pump jet to said engine, wherein said drive train comprises a compound gear rotatably mounted in said upper gear housing and extending into the interior of said drive train casing, said compound gear having an axis of rotation which is coaxial with said pivot axis of said drive train casing.

10. A boat comprising:

a hull with a transom;

an engine mounted inside said hull;

a pump jet apparatus comprising a drive train casing and a pump jet connected to said drive train casing;

a transom plate mounted on the outboard side of said transom and comprising a plate having upper and lower portions;

an upper gear housing connected to said upper portion of said plate;

means for pivotably coupling said drive train casing to said upper gear housing; and a drive train for coupling said pump jet to said engine, said drive train being supported by said upper gear housing and said drive train casing, wherein said means for pivotably coupling said drive train casing and said upper gear housing comprise first and second bearing retainers which are fastened to said upper gear housing and on which said drive train casing is pivotably mounted.

11. The boat as recited in claim 10, further comprising first and second bearing assemblies retained in said first and second bearing retainers respectively, a portion of said drive train being rotatably supported by said bearing assemblies.

12. A boat comprising:

a hull with a transom;

an engine mounted inside said hull;

a pump jet apparatus comprising a drive train casing and a pump jet connected to said drive train casing;

a transom plate mounted on the outboard side of said transom and comprising a plate having upper and lower portions;

an upper gear housing connected to said transom plate;

means for pivotably coupling said drive train casing to said upper gear housing; and a drive train for coupling said pump jet to said engine, said drive train being supported by said upper gear housing and said drive train casing, wherein said transom plate further comprises a tube portion connected to said lower portion of said plate, said hull comprises a water tunnel in flow communication with said tube portion, and said drive train casing is pivotable between first and second positions, said pump jet being in flow communication with said tube portion when said drive train casing is in said first position and being not in flow communication with said tube portion when said drive train casing is in said second position.

13. A boat comprising:

a hull with a transom, said hull comprising a water tunnel having an inlet and a first surface portion;

a transom plate mounted on the outboard side of said transom and comprising a tube portion having a second surface portion;

a pump jet apparatus mounted to said transom plate and comprising a housing having a third surface portion; and means for pivotably mounting said pump jet apparatus to said transom plate, wherein said first, second and third surface portions form a surface for guiding water flow from said water tunnel inlet into said housing.

14. An arrangement for mounting a pump jet on a transom of a boat hull, comprising:

a rotor shaft;

a rotor mounted on said shaft;

a drive train coupled to said rotor shaft;

a mounting plate having holes for mounting on a transom of a boat hull;

a first water tunnel portion connected to said mounting plate and having an inlet and an outlet;

a drive train casing pivotably coupled to said mounting plate and encasing a portion of said drive train, said drive train casing being pivotable relative to said mounting plate between first and second positions; and a second water tunnel portion connected to said drive train casing and having an inlet and an outlet, said inlet of said second water tunnel portion and said outlet of said first water tunnel portion being in abutment when said drive train casing is in said first position and being not in abutment when said drive train casing is in said second position, and said inlet of said second water tunnel portion and said outlet of said first water tunnel portion presenting substantially the same cross-sectional shape to water flowing therethrough, said rotor and said rotor shaft being housed in said second water tunnel portion.

15. The pump jet arrangement as recited in claim 14, wherein a portion of said drive train is coaxial with a pivot axis of said drive train casing.

16. A jet-propelled boat comprising:

a hull comprising a bottom and a transom, said hull bottom comprising a water tunnel which reaches said transom;

a mounting adapter attached to said transom and comprising a generally tubular portion having a water passage placed to receive water via said water tunnel during forward movement of the boat;

a water jet propulsion system comprising a duct having an inlet and an outlet and an impeller rotatable within said duct, said water jet propulsion system being pivotably mounted to said mounting adapter and pivotable about a transverse pivot axis between first and second positions, said duct inlet abutting said generally tubular portion of said mounting adapter when said water jet propulsion system is in said first position and said duct inlet not abutting said generally tubular portion of said mounting adapter when said water jet propulsion system is in said second position.

17. The boat as recited in claim 16, further comprising an inboard engine and a drive train for coupling said impeller to said engine, said drive train comprising a gear which rotates about an axis which is coaxial with said transverse pivot axis.

18. The boat as recited in claim 17, wherein said drive train comprises a shaft which penetrates said hull transom and said mounting adapter.

19. The boat as recited in claim 17, further comprising an upper housing fixed to said mounting adapter, a drive train casing fixed to said duct, and means for pivotably coupling said drive train casing to said upper housing.

* * * * *